United States Patent [19]

Tuttle

[11] Patent Number: 4,879,494

[45] Date of Patent: Nov. 7, 1989

[54] FLUORESCENT LAMP STARTER ASSEMBLY

[75] Inventor: Billy W. Tuttle, Williamsport, Pa.

[73] Assignee: GTE Products Corporation, Danvers, Mass.

[21] Appl. No.: 19,389

[22] Filed: Feb. 26, 1987

[51] Int. Cl.[4] ..... H01J 17/34

[52] U.S. Cl. ..... 315/61; 315/59; 361/399

[58] Field of Search ..... 361/399, 400, 401; 315/59, 60, 61, 62, 57, 53

[56] References Cited

U.S. PATENT DOCUMENTS

| | | | |
|---|---|---|---|
| 4,249,229 | 2/1981 | Hester | 361/400 |
| 4,270,071 | 5/1981 | Morton | 315/53 |
| 4,347,460 | 8/1982 | Latassa et al. | 315/57 |
| 4,414,489 | 11/1983 | Young | 315/51 |
| 4,429,348 | 1/1984 | Dean | 361/399 |
| 4,490,649 | 12/1984 | Wang | 315/50 |
| 4,527,098 | 7/1985 | Owen | 315/289 |
| 4,548,554 | 10/1985 | Angott | 361/399 |
| 4,656,395 | 4/1987 | Fahnrich et al. | 315/57 |

*Primary Examiner*—Benedict V. Safourek
*Assistant Examiner*—T. Salindong
*Attorney, Agent, or Firm*—Carlo S. Bessone

[57] ABSTRACT

In a fluorescent lamp, a starter assembly is disposed in a base of the lamp. The starter assembly includes a circuit board having conductive runs thereon and adapted to support therefrom lamp starter circuit components that are connected to these circuit runs. One or more electrodes of the lamp couple to the printed circuit board conductive runs. The circuit board assembly is supported in the base of the fluorescent lamp.

18 Claims, 4 Drawing Sheets

50
50A
50B
52
53
54
57
58
64
64
60
55
57
56
58
70
92
92
67
68
62
65
66

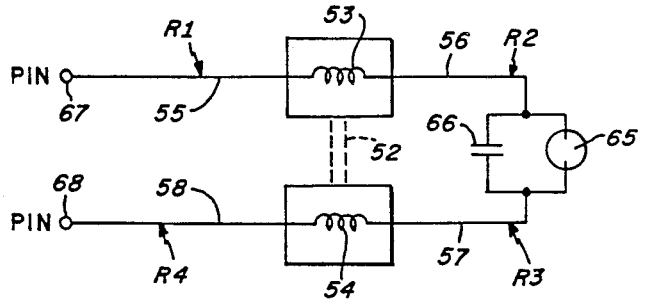
Fig. 4
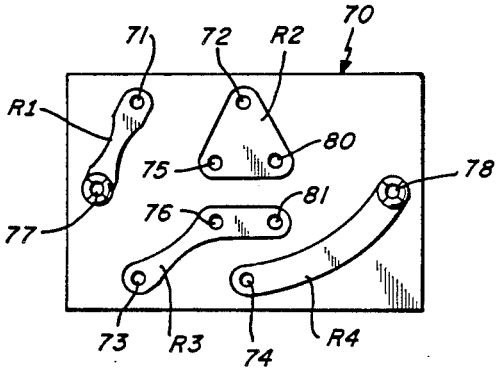
Fig. 5
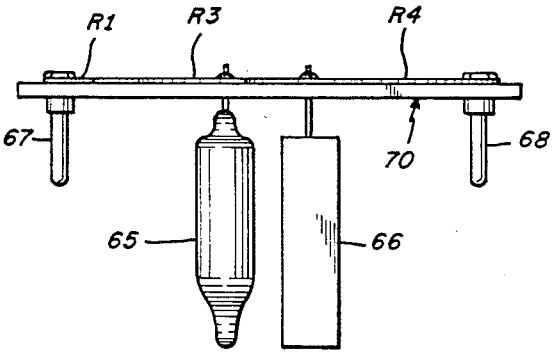
Fig. 6
Fig. 7A
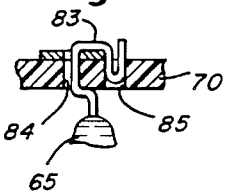
Fig. 7B
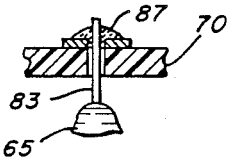
Fig. 7C
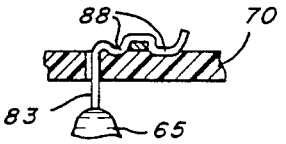

FLUORESCENT LAMP STARTER ASSEMBLYcl

TECHNICAL FIELD

The present invention relates in general to fluorescent lamps, and pertains, more particularly, to high efficiency, low wattage, multiple tube fluorescent lamps. Even more particularly, the present invention relates to an improved starter assembly for a twin-tube or double twin-tube fluorescent lamp.

BACKGROUND OF THE INVENTION

Reference is now made to the prior art drawing of FIG. 1 illustrating a double twin-tube fluorescent lamp assembly as a presently in manufacture. The fluorescent lamp may be of the type manufactured by GTE Products Corporation, either the 9 watt lamp identified by Sylvania Model No. F9DTT/27K or the 13 watt version identified by Sylvania Model No. F13DTT/27K. A similar constructuon is also used in the twin-tube fluorescent lamp. These may be the type presently manufactured by GTE Products Corporation under Sylvania model Nos. F9DDT/27K (9watt) and F13DTT/27K (13watt).

In the prior art drawing of FIG. 1, the fluorescent lamp is comprised of the double twin-tube bulb as illustrated at 10 and is provided with the typical jointing connection as indicated in dotted outline at 12. Associated with the bulb 10 are a pair of filaments, only one of which is illustrated in FIG. 1 at 14. The filament 14 has coupled therefrom lead wires 16 and 18.

The double twin-tube bulb 10 is supported in the two-part base that is comprised of a base shell 20 and base bottom 22. The double twin-tube bulb 10 is secured in the base shell 20 by means of an appropriate cement such as is illustrated at 24 in FIG. 1.

FIG. 1 also illustrates the pins 26 and 28 that are supported from the base bottom. The glow bottle 30 and capacitor 32 comprising the starter circuit are contained within the base bottom 22. With regard to the pins 26 and 28, it is noted that one of the filament wires 16 from the filament 14 is staked into the pin 26 while a lead wire 17 coupled from the other filament is captured and staked at the other pin 28. It is noted that in the prior art fluorescent lamp construction of FIG. 1, clamps are employed as illustrated schematically at 34 and 36. These clamps are used to tie together lead wires for electrical connection between the various components, and in particular for connection between the glow bottle 30, capacitor 32, and lamp filaments. In this regard, note that one of the lead wires 18 from the filament 14 couples to the clamp 36. A lead wire covered by insulator sleeve 38 also couples from the other filament to the clamp 34.

In addition to the requirement of the use of clamps as illustrated at 34 and 36 in FIG. 1, there also have to be provided, insulator sleeves 38 and 40. These sleeves are used to prevent electrical shorting of leads. As indicated previously, the lamp starter components are encapsulated in the two-part base with the two lead wires from the respective lamp filaments being inserted into the pins 26 and 28 and staked to complete the assembly.

One of the disadvantages associated with the prior art construction of FIG. 1 is the relatively large number of separate components that are necessary. In addition to the basic required starter components,. this prior art construction also required clamps and insulator sleeves.

Another disadvantage with the prior art constructuon of FIG. 1 is that the lead wires are too long, particularly when considering use in automated processing. Because of the use of several different length lead wires, there is also a danger in having lamp short circuits. Also, the lengthy leads can provide bending and breakage problems that are inherent with long wires.

A further disadvantage of the prior art construction of FIG. 1 is that the assembly of the lamp is expensive to implement. This is primarily because of the number of components and their complexity of assembly. This limits the speed of production and thus means that the manufacturing cost is higher. The maximum speed of production is about 1000 lamps per hour. The manufacturing efficiently is low and more skilled and unskilled labor is required to service the manufacturing of the product. Ultimately, this means that the product cost to the customer is relarively expensive employing the construction of FIG. 1.

Reference is also made to U.S. Pat. No. 4,426,602. This patent describes a low pressure mercury vapor discharge lamp which is also of prior art construction employing some form of lead interconnection between the filaments and starter circuit.

DISCLOSURE OF THE INVENTION

One object of the present invention, therefore, is to obviate the disadvantages of the prior art.

Another object of the present invention is to provide an improved fluorescent lamp starter assembly employing a circuit board for use in the assembly of the fluorescent lamp.

A further object of the present invention is to provide an improved fluorescent lamp starter assembly requiring fewer component parts, construced to eliminate short-circuiting problems and provided with reduced length lead wires.

Still another object of the present invention is to provide an improved fluorescent lamp starter assembly employing a circuit board and having increased manufacturing efficiency thereof.

Still another object of the present invention is to provide an improved fluorescent lamp starter assembly that is assembled on a more automated basis than prior lamps at increased speed of assembly and in which the assembly may be carried out using conventional equipment.

A further object of the present invention is to provide an improvement in the construction of a starter assembly for a fluorescent lamp that enables the lamp to be manufactured more efficiently, at lower cost and in a more reliable and safe manner.

In accordance with one aspect of the invention, there is provided an improved constructuin for a fluorescent lamp and in particular, an improved fluorescent lamp starter assembly comprising a circuit board assembly. The fluorescent lamp includes a fluorescent tube that is preferably either of twin-tube of double twin-tube configuration. The fluorescent tube includes electrode means supported therein. A base is provided for supporting the fluorescent tube. This base may preferably be a two-part base including a base shell from which the fluorescent tube is supported and a base bottom. The base has supported therefrom, pin means in the form of a pair of oppositely disposed pins that are adapted to be coupled to an energy source for energization of the fluorescent lamp. The circuit board assembly includes a lamp starter circuit and a circuit board having conductive runs thereon and supporting therefrom the lamp starter circuit connecting to circuit runs of the board. The lamp starter circuit may typically comprise a glow bottle and capacitor. Lead means are provided for connecting the electrode means of the fluorescent tube to the circuit board conductive runs. Lastly, means are provided for supporting the circuit board assembly in the lamp base.

In accordance with the assembly sequence regarding the fluorescent lamp of this invention, initially a module is formed comprised of the glow bottle, capacitor and pins, all preassembled with the circuit board. This preassembly step may be carried out at high speeds using conventional assembly equipment. As indicated previously, the fluorescent lamp, in addition to the multi-tube bulb also includes a base comprised of a base shell and base bottom. The fluorescent bulb is secured in the base shell with filament leads extending therefrom. The circuit board assembly module is supported in the base shell and the filament lead wires are secured thereto. Thereafter, the base bottom is engaged with the base shell disposed over the circuit board, encasing the starter circuit (capacitor and glow bottle) and adapted to recieve the pin means which depend therefrom.

BRIEF DESCRIPTION OF THE DRAWINGS

FIG. 4 is a schematic circuit diagram of the circuit interconnection of lamp components;

FIG. 5 is a plan view of the circuit board itself illustrating the configuration of circuit runs;

FIG. 6 is a side elevation view of the circuit board assembly illustrating the glow bottle, capacitor and pins secured to the circuit board; and FIG. 7A-7C illustrate fragmentary views of different techniques for securing components to the circuit board including respective clamping, soldering and welding techniques.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
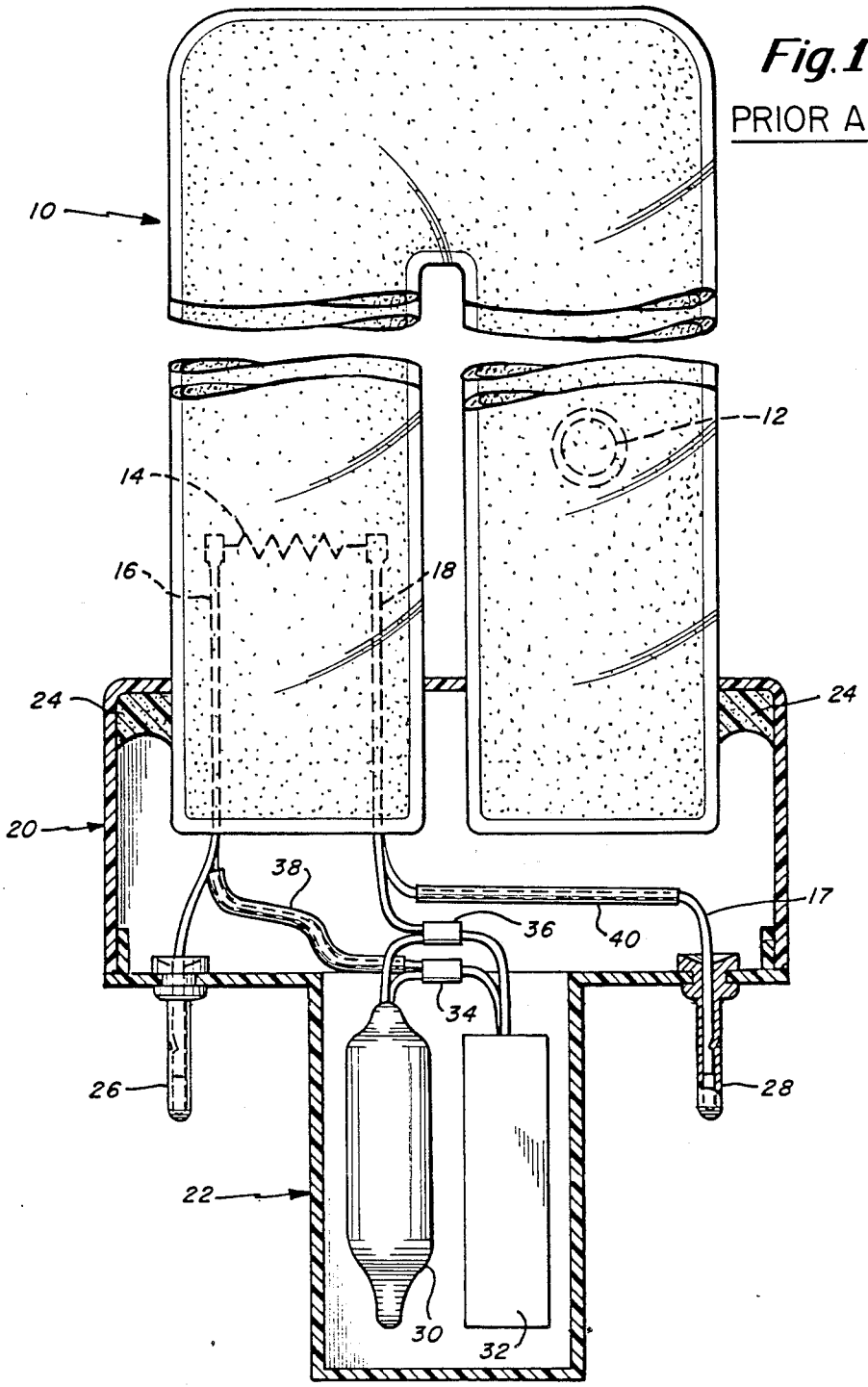
Fig. 1 PRIOR ART
FIG. 1 is a side elevation view, in partial cross-section illustrating a prior art construction of a double twin-tube fluorescent lamp.

In accordance with the present invention, the fluorescent lamp has a starter circuit that now includes a circuit board. The circuit board enables ready securing of the glow bottle, capacitor and pins in a compact module. Refer to FIG. 6 for an illustration of the basic module. This module can be preassembled at high speed using conventional equipment. These modules can be manufactured at a speed of about 4000 per hour. This means that there is lower equipment cost and less labor to assemble parts, again reducing the cost of the overall product. The on-line assembly operation costs less due to fewer components in the overall device. In this regard, compare FIGS. 1 and 2.

Figure 2:
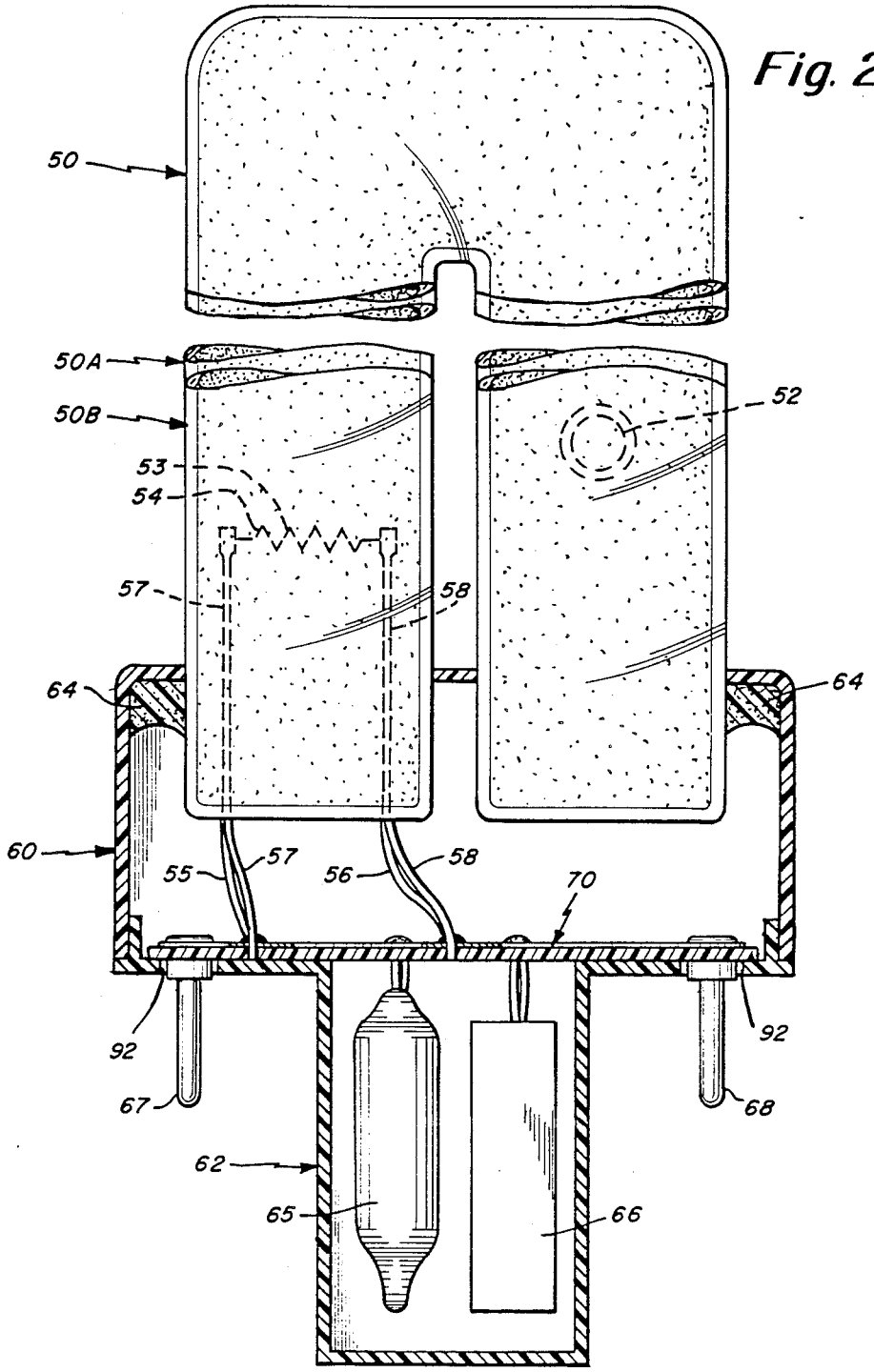
FIG. 2 is a side elevation view, in partial cross-section of an embodiment in accordance with the present invention employing a circuit board.
Figure 3:
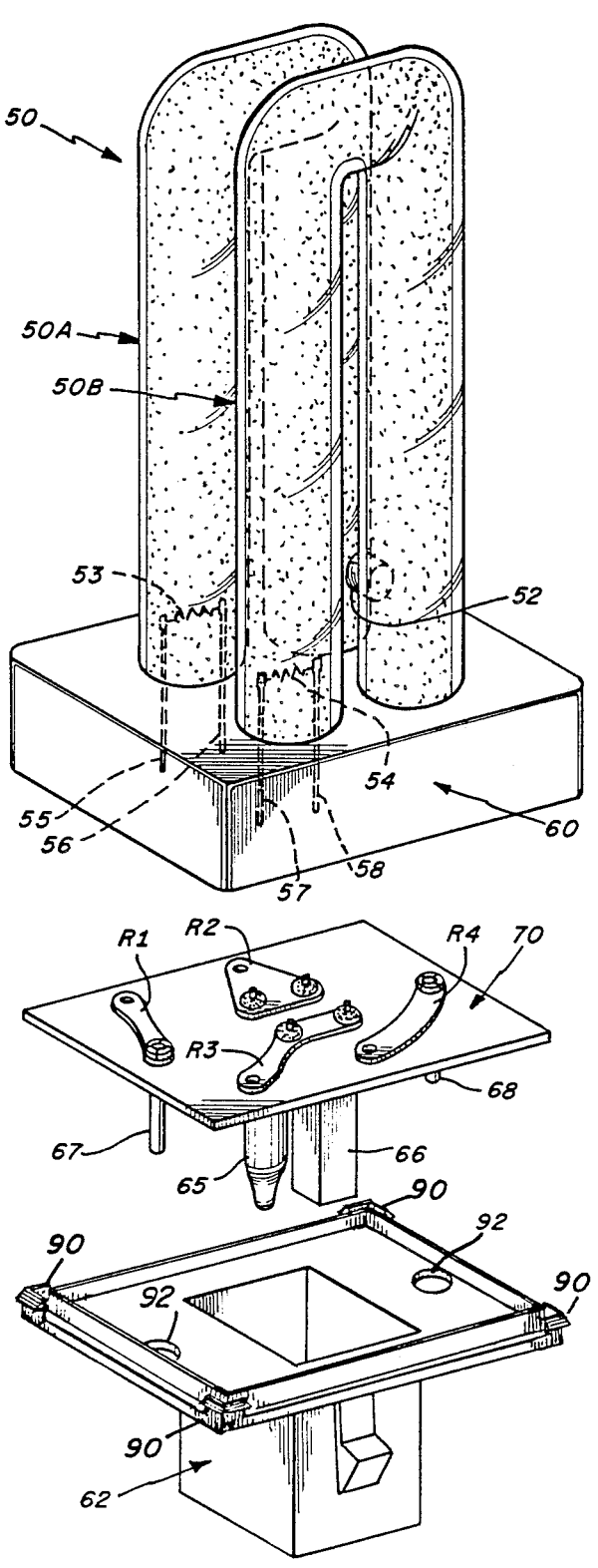
FIG. 3 is an exploded perspective view of the double twin-tube fluorescent lamp of FIG. 2, showing further details and cooperation of parts.

The manufacturing efficiency is much higher with the improved version of the invention as illustrated in FIGS. 2 and 3. This further reduces the cost of the overall product. Also, with the use of the circuit board in the assembly, lead lengths are drastically reduced or, in some instances, essentially eliminated and with the use of a circuit board, short circuit problems are essentially eliminated. The construction of the device is such as to provide a more reliable and safer product and is characterized by improved quality at lower cost.

Reference is now made to FIGS. 2 and 3. FIG. 2 is an elevation view showing the complete lamp assemby. FIG. 3 is an exploded perspective view showing still further lamp details. The principles of the present invention may be employed in the construction of either twin tube or double twin-tube fluorescent lamps. The principles of the invention may be employed in constructing different wattage lamps, such as the typical 9 watt and 13 watt compact, high efficiency fluorescent lamps. Moreover, it is expected that the principles of the invention may be employed in the assembly of other lighting products, particularly ones requiring the assembly of more than one circuit component.

FIGS. 2 and 3 illustrate a double twin-tube fluorescent lamp comprising the double twin-tube bulb 50 comprised of single twin-tube bulbs 50A and 50B intercoupled via the jointing connection as illustrated in dotted outline in FIG. 2 at 52. Filaments 53 and 54 are supported in the respective tubes 50A and 50B. The filament 53 has associated lead wires 55 and 56 while the filament 54 has associated lead wires 57 and 58. The lead wires 55–58 are secured to the circuit board 70 as will be described in further detail hereinafter.

A base is provided for suporting the starter circuit, circuit board 70, and the double twin-tube bulb 50. The base is comprised of a base shell 60 and a base bottom 62. The double twin-tube bulb 50 is secured in the base shell 60 as illustrated in FIG. 2 with the use of a suitable cement as indicated at 64.

FIGS. 2 and 3 also illustrate the starter circuit itself, which is comprised primarly of the glow bottle 65 and capacitor 66. Also illustrated are the pins 67 and 68 depending from the circuit board 70.

Reference is now made to FIGS. 5 and 6 for further details of the circuit board 70 and associated components mounted therefrom as particularly illustrated in FIG. 6. The circuit board 70 can be manufactured using known technologies including die stamping, silk screening, or etching. The circuit board is comprised of a suitable substrate board with tin-coated copper foil as the circuit material. As illustrated in FIG. 5, the circuit board 70 has four circuit runs identified as runs R1–R4. Each of these circuit runs has at least one lead wire hole. The runs R1 and R4 have pin holes 77 and 78 associated respectively with pins 67 and 68. Runs R1 and R4 also have one additional lead wire hole. The runs R2 and R3 each have, three lead wire holes.

With regard to the connections of the various components to the circuit board 70, in FIG. 5 the lead wires 55 and 56 from filament 53 are coupled to the holes 71 and 72 of respective circuit runs R1 and R2. The lead wires 57 and 58 of filament 54 are coupled to holes 73 and 74 of respective circuit runs R3 and R4. Furthermore, the leads of the glow bottle 65 couple at the holes 75 and 76. The lead wires from the capacitor couple to lead wire holes 80 and 81 in FIG. 5.

Reference is now made to FIG. 4 which shows the complete schematic circuit diagram. In FIG. 4 it is noted that from the input pin 67 via circuit run R1, connection is made to the filament 53 at lead wire 55. From lead wire 56 of the filament 53, the connection is by way of the circuit run R2 to the lead wires on one side of glow bottle 65 and capacitor 66. The other side leads of glow bottle 65 and capacitor 66 connect by way of the circuit run R3 to the lead wire 57 of filament 54. The other lead wire 58 of filament 54 couples by way of circuit run R4 to pin 68.

As indicated previously, the glow bottle, capacitor, pins and circuit board form a module. The components themselves may be secured to the circuit board by one of the techniques described in FIGS. 7A–7C. By way of example, each of these illustrations covers the securing of a component such as the glow bottle to the circuit board 70. In FIG. 7A, a clamping method is employed in which the lead wire 83 from the glow bottle is clamped over the circuit run. In this particular embodiment, a pair of adjacent disposed holes as indicated at 84 and 85 are used to accommodate the lead wire 83.

FIG. 7B shows a soldering method in which the lead wire 83 extends through the lead wire hole in the substrate circuit board 70. The lead wire 83 is then soldered at the top of the board as indicated at 87.

FIG. 7C shows a sonic welding technique for securing the lead wire 83 to the circuit board run. A sonic welding may be provided at 88 to secure the lead wire to the circuit run.

In addition to the methods of securing the component illustrated in FIGS. 7A–7C, other techniques may also be employed for coupling lead wires of components to the various circuit runs illustrated in FIG. 5. Moreover, the circuit runs can be provided in different configurations than that illustrated in FIG. 5.

Once this circuit board module has been assembled such as illustrated in FIG. 6, then the circuit board may be at least partially enaged into the base shell but leaving sufficient clearance so that one can also secure the filament leads at holes 71, 72, and 73, 74 to attach the filament also to the circuit board. To carry this out, the filament lead wires may extend through the corresponding holes and be soldered or otherwise suitably secured at the bottom side of the circuit board. The circuit board 70 may then be snap-fitted or may then be disposed in the base shell 60 such as in the position of FIG. 2. Once the filament leads are soldered, then the circuit board 70 is for the most part supported directly by these lead wires.

After the circuit board 70 is in place, then the base bottom 62 is shaped against the circuit board and into engagement with the base shell 60 to complete the assembly. In this connection, the base bottom 60 may have a conventional type of snap securing member such as illustrated at 90 in FIG. 3. Also, the base bottom 62 is provided with a pair of holes 92 (see FIG. 3) for accommodating the pins 67 and 68 that are adapted to extend therethrough. When the base bottom 62 is snapped into position, then the assembly is completed.

Thus, in accordance with the present invention, there is provided an improved arrangement for providing continuity between the fluorescent bulb, glow bottle, capacitor, and pins. In addition to providing electrical continuity, the circuit board also provides a mounting structure for these components. The circuit board is made of an insulating material which thus prevents shorting between leads. The circuit components are attached to the board preferably using conventional industry technology. The product is fabricated in a manner so that the components are secured in fixed position so that they connot move, be dislodged or disconnect from the circuit board during handling of the product.

While there have been shown and described what are at present considered the preferred embodiments of the invention, it will be obvious to those skilled in the art that various changes and modifications may be made therein without department from the scope of the invention as defined from the appended claims.

What is claimed is:

1. In a fluorescent lamp including a fluorescent tube having electrode means supported therein, and a base from which the fluorescent tube is supported, a circuit board assembly for support in said lamp base and comprising; a lamp starter circuit, a circuit board having conductive runs thereon, pin means extending outside from within said base for enabling energy coupling to said electrode means, means for supporting the pin means from said circuit board, means connecting the lamp starter circuit to the circuit board conductive runs, and means connecting the lamp electrode means to the circuit board conductive runs.

2. In a fluorescent lamp as set forth in claim 1 wherein the means connecting the lamp starter circuit to the conductive runs includes clamping means.

3. In a fluorescent lamp as set forth in claim 1 wherein the means connecting the lamp starter circuit to the conductive runs includes solder means.

4. In a fluorescent lamp as set forth in claim 1 wherein the means connecting the lamp starter circuit to the conductive runs includes welding means.

5. In a fluorescent lamp as set forth in claim 1 wherein the means connecting the lamp electrode means to the conductive runs includes clamping means.

6. In a fluorescent lamp as set forth in claim 1 wherein the means connecting the lamp electrode means to the conductive runs includes solder means.

7. In a fluorescent lamp as set forth in claim 1 wherein the means connecting the lamp electrode means to the conductive runs includes welding means.

8. In a fluorescent lamp as set forth in claim 1 wherein said lamp starter circuit comprises a glow bottle and capacitor coupled to conductive runs of the circuit board to dispose the glow bottle and capacitor in a parallel circuit.

9. In a fluorescent lamp as set forth in claim 1 wherein said lamp base includes a base shell and base bottom with the circuit board disposed over the base bottom.

10. In a fluoresccent lamp as set forth in claim 9 wherein the base bottom has holes therein for receiving therethrough the pin means.

11. A fluorescent lamp comprising:

a multi-section fluorescent tube including electrode means supported therein;

a base for supporting said fluorescent tube;

a circuit board assembly including;

a lamp starter circuit, pin means extending outside from within said lamp base, a printed circuit board having conductive runs thereon and supporting therefrom the lamp starter circuit and the pin means connecting to circuit runs thereof, lead means for connecting the electrode means of the flourescent tube to the printed circuit board conductive runs, and means for supporting the circuit board assembly in said base.

12. A fluorescent lamp as set forth in claim 11 wherein the lamp starter circuit includes a plurality of components and means for connecting the components to the conductive runs by one of clamping, soldering and welding.

13. A fluorescent lamp as set forth in claim 12 wherein the lamp base includes a base shell and base bottom with the circuit board supported over the base bottom in contact therewith.

14. A fluorescent lamp as set forth in claim 13 wherein the base bottom has holes therein to receive therethrough the pin means.

15. A fluorescent lamp as set forth in claim 11 including four conductive runs.

16. In a fluorescent lamp including a fluorescent tube having electrode means supported therein, a base from which the fluorescent tube is supported, and pin means for enabling energy coupling to said electrode means, a method of assembling a starter circuit in the lamp base comprising the steps of, providing a circuit board having conductive runs thereon, connecting the components of the lamp starter circuit to the circuit board conductive runs, supporting the pin means from the circuit board, connecting the lamp electrode means to the circuit board conductive runs, and retaining the circuit board in the lamp base with the pin means extending outside from within the lamp base.

17. The method of claim 16 including supporting the pin means directly from the circuit board.

18. The method of claim 17 including providing holes in the base to receive the pin means.

* * * * *